United States Patent [19]

Da Col

[11] Patent Number: 4,887,402

[45] Date of Patent: Dec. 19, 1989

[54] STRUCTURAL GLAZING SYSTEM

[75] Inventor: Diego Da Col, Via Benedetti 43, 37135 Verona, Italy

[73] Assignee: Diego Da Col, Verona, Italy

[21] Appl. No.: 226,927

[22] Filed: Aug. 1, 1988

[30] Foreign Application Priority Data

Aug. 7, 1987 [IT] Italy ..... 84963 A/87

[51] Int. Cl.[4] ..... E04H 1/00

[52] U.S. Cl. ..... 52/235; 52/66; 52/68; 52/461

[58] Field of Search ..... 52/202, 235, 460, 461, 52/466, 467, 468, 472

[56] References Cited

U.S. PATENT DOCUMENTS 3,778,958 12/1973 Fowler ..... 52/461 X
4,339,901 7/1982 Hubbard ..... 52/202
4,418,506 12/1983 Weber ..... 52/235 X
4,475,325 10/1984 Veldhoen ..... 52/235
4,563,848 1/1986 Gartner ..... 52/235

*Primary Examiner*—Carl D. Friedman
*Assistant Examiner*—Jerrold D. Johnson
*Attorney, Agent, or Firm*—Guido Modiano; Albert Josif

[57] ABSTRACT

A structural glazing system for obtaining continuous glazed facades, comprising a supporting structural framing including a plurality of uprights and transoms securable to the supporting structure of a building to be glazed, a plurality of panels, concealed support and mounting means arranged to secure each panel to the structural framing to form, in use, a mosaic of co-planar panels forming a continuous glazed facade, each panel being separated from the others by gaps, and a plurality of gap-covering slates designed to be removably secured to the structural framing and to provide uniformity and continuity in the panel mosaic.

15 Claims, 12 Drawing Sheets

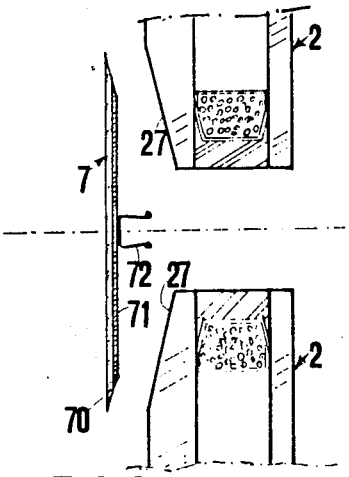
FIG.6
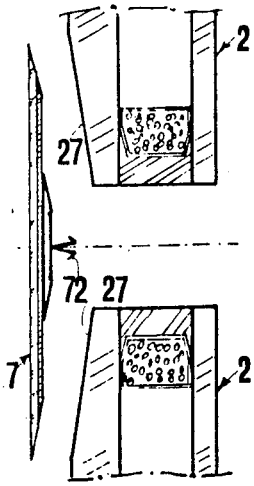
FIG.7
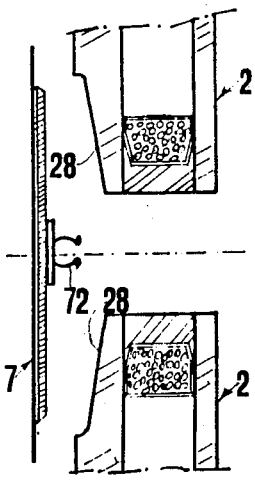
FIG.8
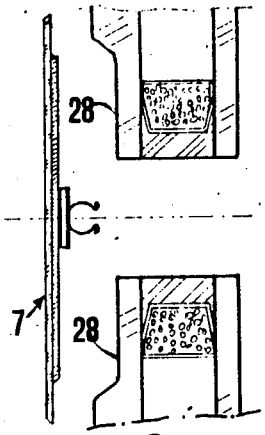
FIG.9
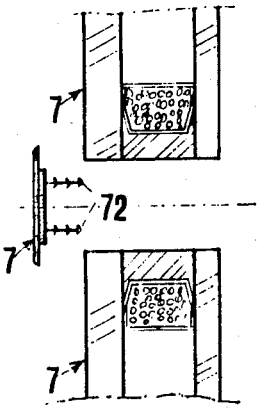
FIG.10
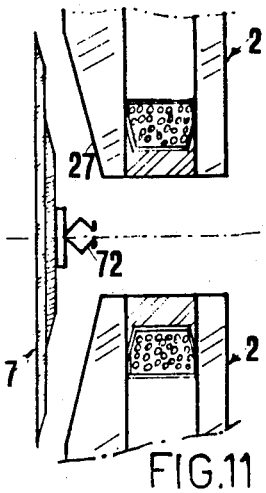
FIG.11
FIG.12
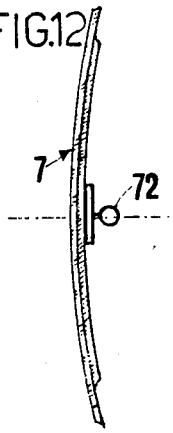
FIG.13
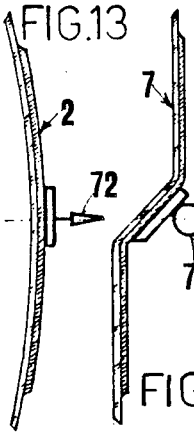
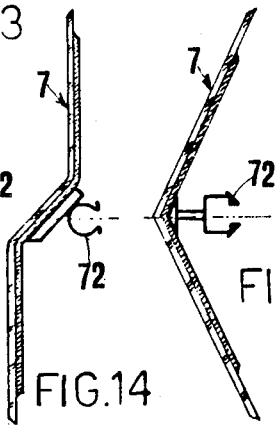
FIG.14
FIG.15
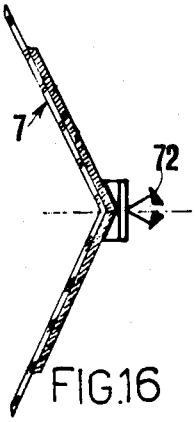
FIG.16

FIG.23
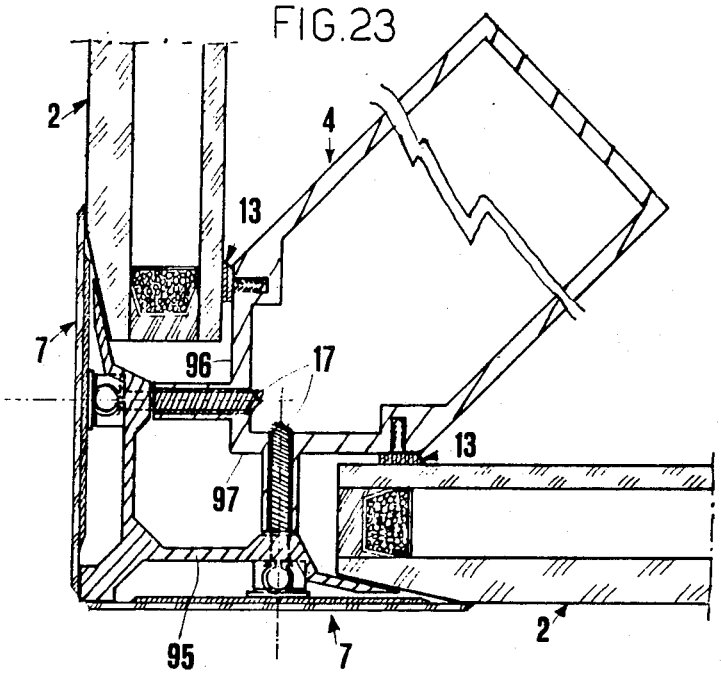
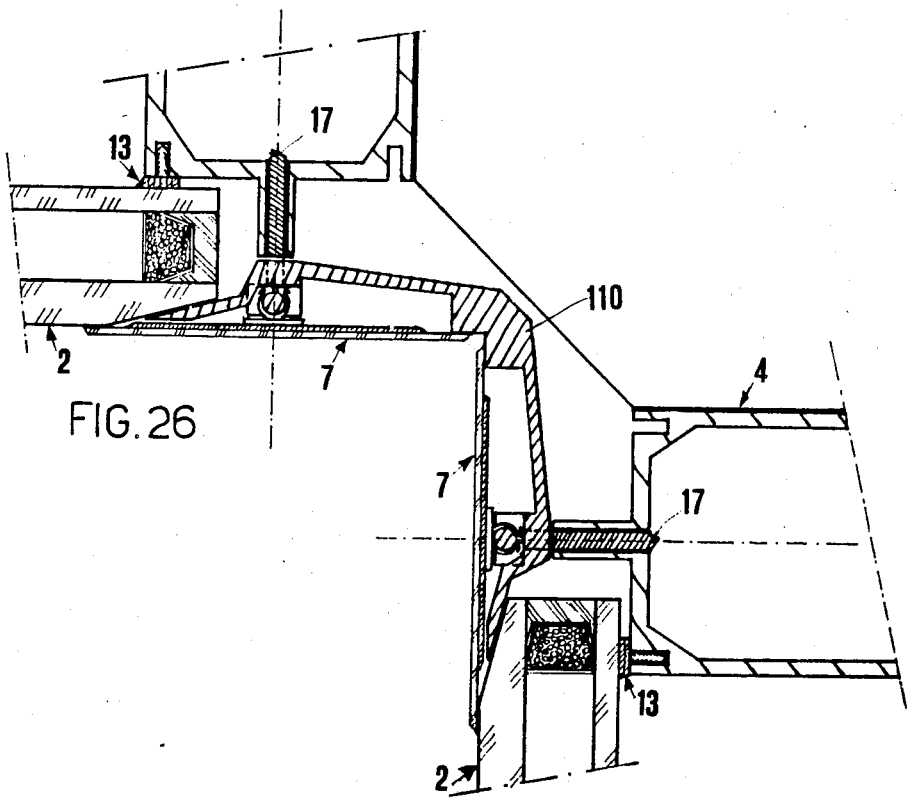
FIG.26

STRUCTURAL GLAZING SYSTEM

BACKGROUND OF THE INVENTION

The present invention relates to a structural glazing system for forming continuous facades.

Systems for obtaining continuous glazed facades have already been proposed in the art, and which include laying a fixed structural framing comprising a plurality of uprights and crosspieces or transoms, which are fixed to the supporting structure of the building to be glazed. Glass panels are mounted on a respective concealed peripheral frame and then secured to the supporting structural framing. Sealing between adjacent glass panels and possibly between the panels and the structural framing is performed by means of silicone sealant, termed "structural silicone", which is structurally made to adhere to the sides of the glass panels by means of special sealants marketed by a small number of highly specialized manufacturers.

Structural-silicone systems make it possible to obtain continuous glazed facades in which the various glass panels are spaced from one another by very narrow gaps, having a width of the order of 15 mm, usually fully or partly occupied by structural silicone, which produces a regular checker-like partition among the glass panels. The aesthetical and architectural virtues of a structural-silicone glazed facade are undoubtedly appealing.

However, the use of structural silicones requires a quite complicated and, above all, costly sealing operation for a number of reasons. First of all, structural silicones are available on the market at high costs and their reliability, in use, is attained only if severe conditions and specific requirements are fulfilled in so far as quality, type and nature of the materials being used, sealant application procedures, which must be executed in factory, and features of the structural framing are concerned. Should the sealant accidentally provide faulty adhesion, the glass panels fall from the facade of the glazed building with severe risk of damaging people and property.

SUMMARY OF THE INVENTION

An object of the present invention is to provide a structural glazing system arranged to eliminate or substantially reduce the checkered effect due to partitions between the glass panels of a glazed facade, without, however, using structural silicones and therefore without the disadvantages connected to their use.

Another object of the present invention is to obtain continuous glazed facades having a great uniformity and continuity in color and reflection, without creating regular "checker-like" partitions or any other pattern between one panel and the other.

Another object of the present invention is to ensure safe retention of each panel in position even in case of breakage or cracking of the glass or other material the panel is made of.

Another object of the present invention is to provide a structural glazing system quite competitive, at least so far as costs are concerned, with respect to conventional glazing systems.

These and other objects which will better appear hereinafter are achieved by a structural glazing system for forming continuous glazing facade on buildings, comprising a structural framing including a plurality of uprights and crosspieces or transoms securable to the supporting structure of a building to be glazed, a plurality of panels, concealed supporting and mounting means arranged to secure each panel to the structural framing to form, in use, a mosaic of co-planar panels forming a continuous glazed facade each glass panel being separated from the other by a small uninterrupted gas, and a plurality of gap-covering slate elements designed to be removably secured to the structural framing and to provide surface continuity and uniformity of the panel mosaic.

The panels advantageously comprise glass panes, in which case the gap-covering slate elements may have a reflecting outer surface ensuring continuity in the reflection on the entire glazed surface of the mosaic.

BRIEF DESCRIPTION OF THE DRAWINGS

Further features and advantages of the present invention will become better apparent from the following detailed description of some specific embodiments thereof given with reference to the accompanying drawings, wherein:

FIGS. 6 to 11 are partial sectional views which illustrate various chamfering configurations on panels and of gap-covering slate elements;

FIGS. 12 to 16 are cross-sectional views of various embodiments of gap-covering slate elements;

FIG. 23 is a horizontal sectional view at a 90° sharp-edge corner gap of a glazed facade;

FIG. 26 is a horizontal sectional view taken at a 90° closed corner gap provided with a double gap-covering slate element;

DESCRIPTION OF THE PREFERRED EMBODIMENTS

Figure 2:
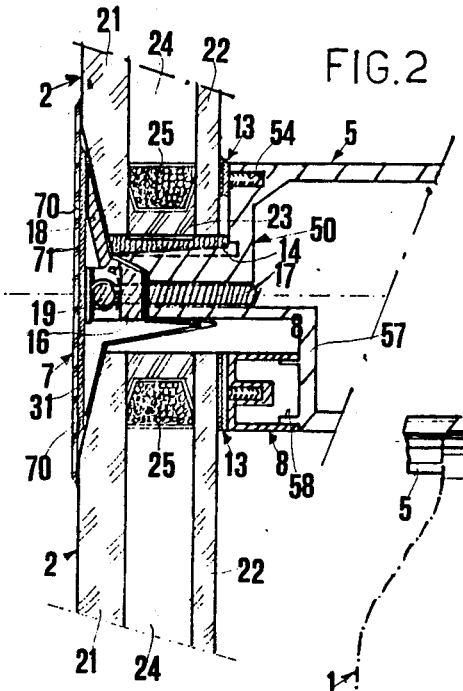
FIG. 2 is an enlarged-scale sectional view taken along the line II—II of FIG. 1.
Figure 1:
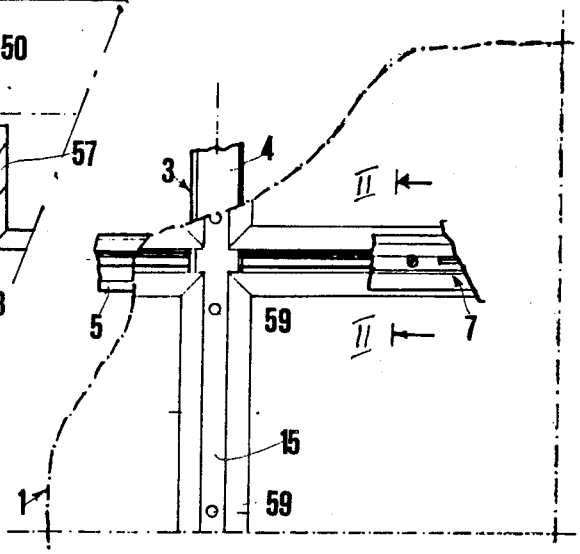
FIG. 1 is a schematic front elevation view, with cut-out portions, of a structural glazing system.
Figure 1:
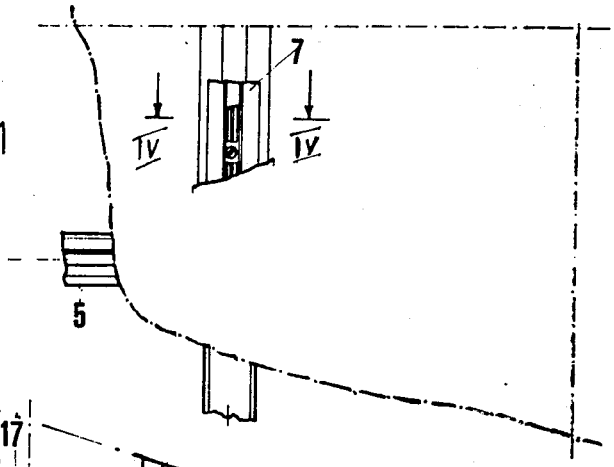
Figure 4:
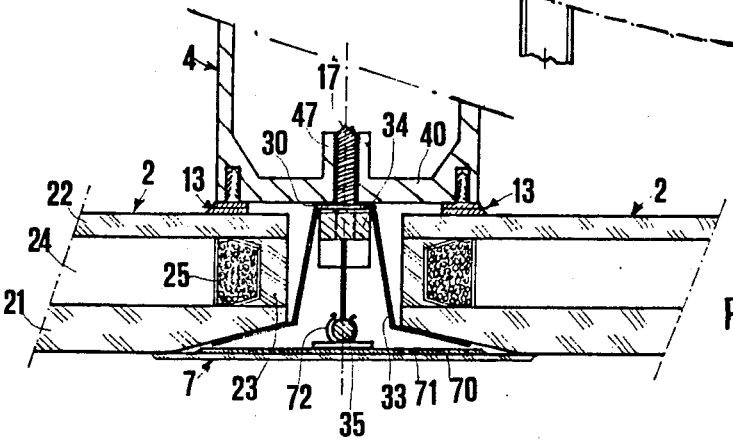
FIG. 4 is an enlarged-scale sectional view taken along the line IV—IV of FIG. 1.
Figure 3:
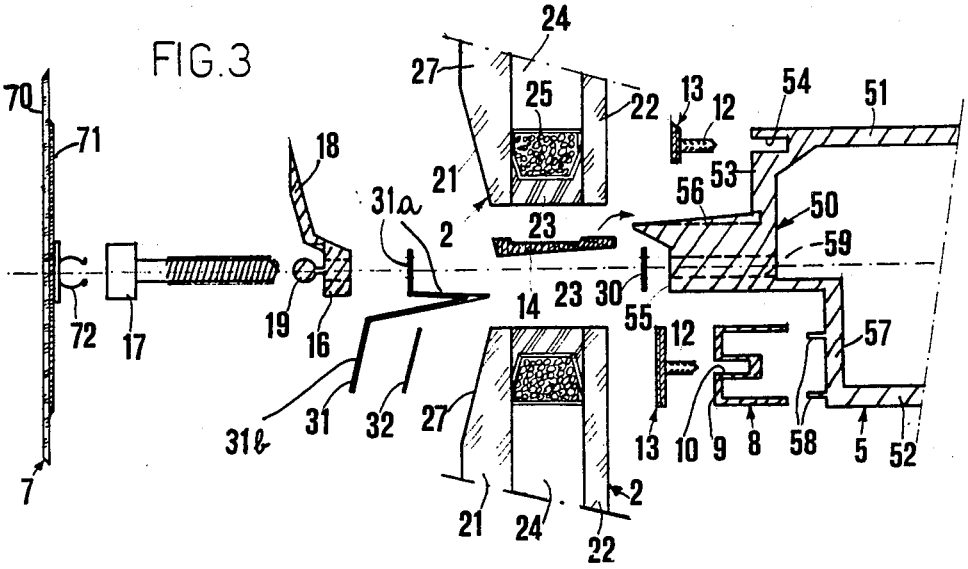
FIG. 3 is an exploded view of FIG. 2.

In the accompanying drawings, identical or similar parts or components are indicated by the same reference numerals.

With reference first to FIGS. 1 to 5, reference numeral 1 generally indicates a system for obtaining continuous glazed facades according to the invention, which comprises a plurality of box-like glass panels 2, arranged co-planar or mosaic-like, on an outer wall of a building to be glazed, a structural framing 3 including a plurality of uprights 4 and transoms or crosspieces 5 designed to be fixed to the supporting structure of the building, and supporting and fixing means, which will be further described hereinafter for securing the panels 2 to the structural framing 3.

The uprights 4 and the transoms 5 can include metallic structural shapes, e.g. extruded aluminum-alloy sections, or wooden splines or sections made of another suitable material and are secured through fixing means, such as inserts, retaining or hooking rods, to the reinforcement of the reinforced-concrete structure of the building facade or the like to be glazed.

Installation of the uprights and transoms results in laying the structural framing 3 on the rough facade of the building to be glazed, thereby obtaining a fixed bed on which panels 2 can be mounted.

The uprights 4 and the transoms or crosspieces 5 can comprise in particular, channel sections or tubular elements having two parallel side flanges, 41, 42 and 51, 52 respectively, joined to one another by a transverse flange 40, 50 against which panels 2 can abut. The flange 40 of each upright has an outer flat face 43 formed with two lateral longitudinal recesses 45 and 46. Along the flange 40 there is provided a longitudinal rib or raised portion 47 in which a number of mutually spaced holes 48 are formed. The flange 50 of each transom 5 comprises instead three portions, i.e. a first portion 53 delimiting a flat outer face in which a lateral longitudinal groove 54 is provided at the flange 51, a second portion 55 delimiting a bracket on which a seat 56 is provided, and a third portion 57 extending parallel to the portion 53, but recessed with respect to both portion 53 and the bracket 55, and formed with a pair of outer parallel ridges 58. The ridges 58 are designed to be engaged by an M-shaped section 8 which can be secured thereto by means of a suitable fixing means, such as screws and the like, or in a snap-together fashion. The section 8 has an outer flat front face 9 formed with a longitudinal groove 10.

Each transom 5 can also have its portions 53 and 57 arranged aligned one after the other when no use is made of section 8, e.g. on facades having no window panels that can be opened.

The longitudinal recesses 45, 46 in the uprights and 54 on the transoms and 10 on the section 8 are designed to form a number of receiving seats for a stem 12 of a respective T-shaped section 13 which can be secured therein by means of suitable fixing means, e.g. by pressure inserting its respective recess. The section 13 acts as a gasket and is preferably made of a soft and thermally insulating material.

The panels 2, in the embodiment illustrated in FIGS. 1 to 5, are fabricated from a combined element made of insulating glass panes, also termed box-like glass panels, comprising an outer reflecting pane 21, having a considerable thickness, e.g. 8 mm, and an inner pane 22 having a smaller thickness, e.g. 4 mm which is held fixed to, and spaced from, the outer reflecting pane by a seal 23. The outer and inner panes 21 and 22 have the same contour configuration and the same dimensions, except their thickness. The seal 23 uninterruptedly extends flush with the panes and provides a so-called "perimetric airtight seal" for the panes 21 and 22, so that an air interspace or chamber 24 is delimited between the two panes, which is kept dehydrated by providing some salts 25 conveniently arranged in an inner groove 26 of the seal 23. The latter can be made rigidly to adhere in an air-tight manner to the inner faces of the panes 21 and 22 by means of a suitable sealant, as is well known in the art.

Each box-like glass panel 2, once it is made to rest on a respective insert 14 provided in the seat 56 of a supporting transom 5 to avoid direct contact with its flat face 53, abuts against the gaskets 13 which also ensure heat insulation. Once the panel 2 has been layed it is secured to the structural framing 3 by means of suitable pane-holders, 16 and 31 at the transoms, 34 and 33 at the uprights. The pane-holders 31 and 33 are advantageously made of metal plate which has a substantially V- or U-shaped configuration in cross section and is weatherproof and resiliently yielding along the laying plane of the continuous glazed facade to compensate for the thermal expansion of the panels. As visible from the drawings, each pane holder 31, 33 comprises a monolithical structure defining a frame coupling portion **31*a*, 33*a* for resting against and being secured to the structural framing 3, and a panel clamping portion 31*b*, 33*b* for resting against an external engagement edge portion 27 of the panels. As also visible from the drawings, the clamping portion 31*b*, 33*b*** is substantially thin and is arm-like shaped.

Owing to the configuration and dimensioning of the various components, the various panels 2, after laying are actually co-planar, but mutually separated by respective gaps 15 (FIG. 1) which may be several centimeters wide, among other things, to allow the unrestricted thermal expansion of the panels.

To ensure continuity in the reflection throughout the entire glazed surface, gap-covering slate elements 7 are provided which can have various configurations and structures (see also FIGS. 6 to 16). Each gap-covering slate element can be constituted by a suitable plate 70 of transparent or non-transparent material having an outer or inner surface at least partly reflecting, such as a plastic material, e.g. plexiglass, polycarbonate, ABS, safety glass, reflective plastic films, which is shock resisting and weatherproof, and by supporting and coupling means. The plate 70 can be much thinner than the glass panels and have a width slightly greater or slightly smaller than, or equal to, the width of the gap 15 to be covered (FIG. 10).

Advantageously, each panel 2 has, along the peripheral border or borders of its external reflecting face, a chamfering 27 which can be a beveling inclined to more or less extend as shown in FIGS. 1 to 7 and 11, or a chamfering 28, as shown in FIGS. 8 and 9. In the case of beveled or chamfered panels, the plate 70 has a width substantially equal to that of the gap plus that of a double beveling or chamfering.

The plate 70 can be supported by a stiffening rolled section 71 fixed to the plate by means of any suitable means, e.g. by means of a sealant. A suitable coupling means 72 for removably fixing in position the slate element 7 is secured to the rolled section 71. The coupling means 72 can be constituted by a resilient U-shaped clamp, as shown in FIGS. 1 to 6, 8, 9, 11, 14, 15 and 16, or by an expansion insert as shown in FIG. 7 or by a bulge for snap-together coupling as shown in FIGS. 12 and 13.

The gap-covering slate elements 7 designed to cover cross or horizontal gaps (see in particular FIGS. 2 and 3) can removably engage with a spacer section, which can be the pane-holder 16 itself, and can be head fixed to the bracket 55 of a transom 5, e.g. by means of bolts 17 screwed into specifically provided holes 59.

Each section element 16 has a lateral flange 18 for resting against the upper panel and a bead 19 defining an engagement member for removable or snap-together engagement with the coupling means 72 of the respective gap-covering slate element 7.

For coupling the vertical gap-covering slate elements (see FIGS. 4, 5), a spacer section element 34 is provided, having a bead 35 defining an engagement member arranged to removably engage with a U-shaped clamp 72. Each section element 34 can be fixed to the face 43 of an upright 4 by means of bolts 17 screwable into the holes 48.

Between each pane-holder 31, 33 and its respective resting wall 55, 43, protection gaskets 30 are advantageously provided, whereas gaskets 32 can be located between pane-holder and panel. The gaskets 30 and 32 also ensure watertightness.

With the above described arrangement, along each transom the upper panels are held in position against the structural framing 3 by the pane-holder/spacer 16, whereas the lower panels are engaged by the pane-holder 31. The panels are instead engaged in pairs by the pane-holders 33 along the uprights.

Figure 17:
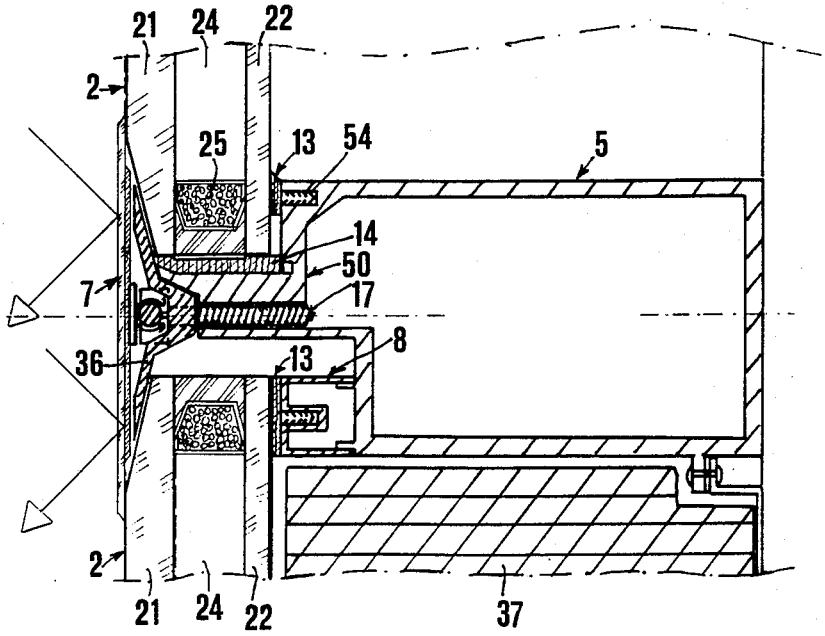
FIG. 17 is a partial vertical sectional view of a glazed facade obtained with a structural glacing system which requires in-yard assembling of the glass panels.
Figure 5:
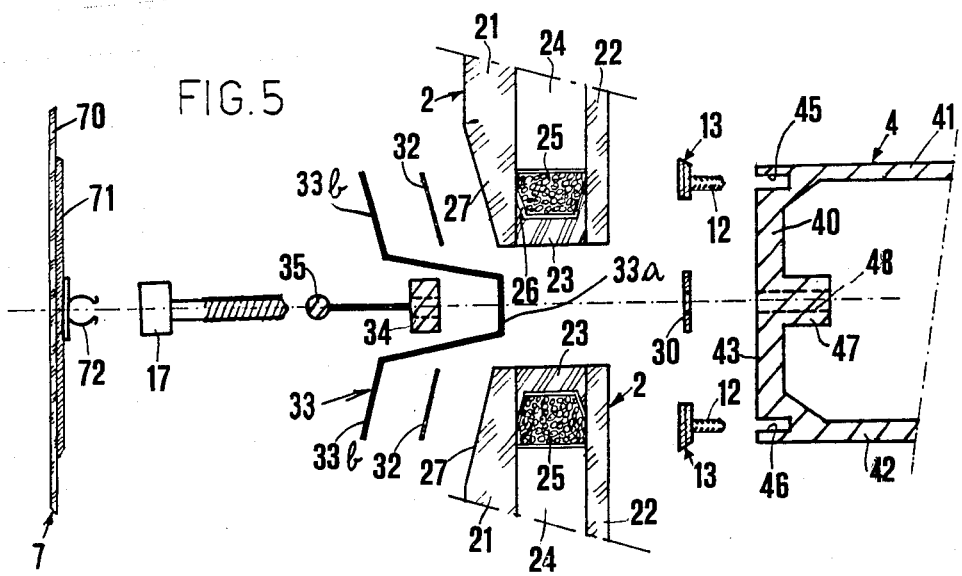
FIG. 5 is an exploded view of FIG. 4.

FIG. 17 illustrates a modification of the system according to the invention, which is particularly suitable for the in-yard assembling of the panels 2. It will be noted the structure with two lateral flanges of the pane-holder section element 36. The outer face 28 of the inner pane 22 of the lower box-like glass panel can also be enameled to eliminate any dark background which would otherwise be visible on the continuous glazed facade, due to the presence of a blank panel 37 provided between the face panel and the wall of the building at the level of a breastwork and of the wall portion underneath at each floor-slab or storey of the building.

Figure 18:
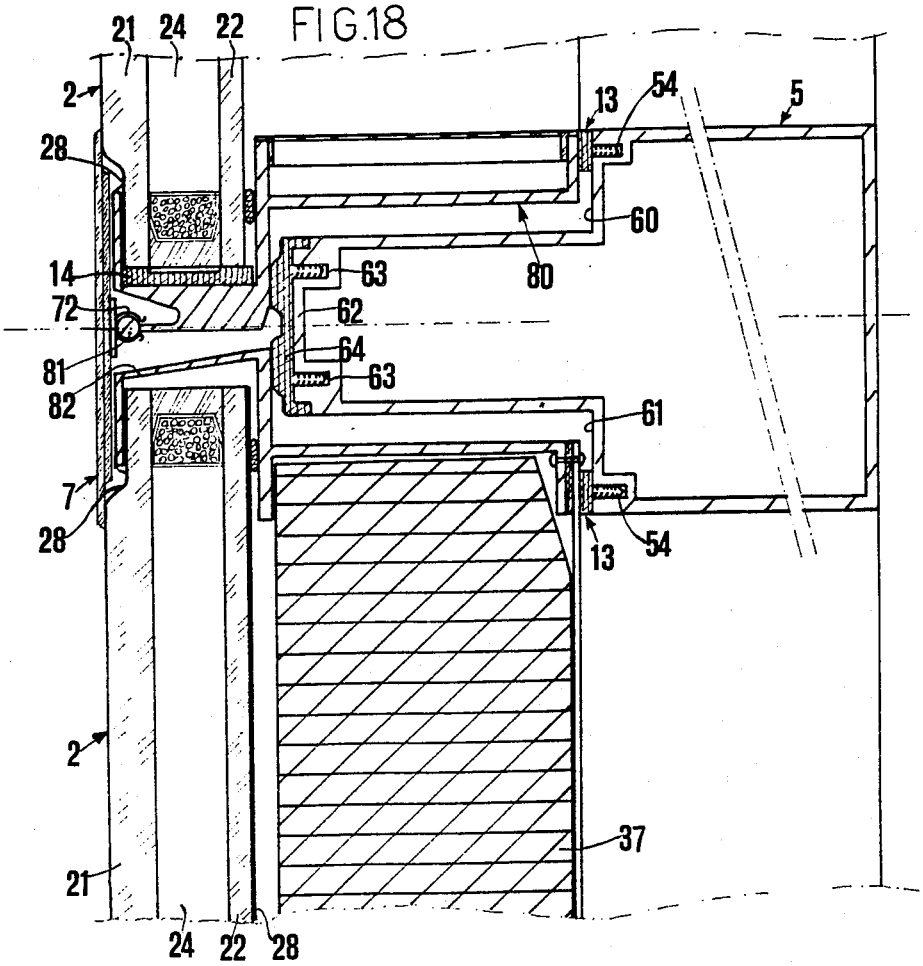
FIG. 18 is a partial vertical sectional view of a glazed facade obtained with a structural glazing system which requires in-works assemblying of the glass panels.

The embodiment shown in FIG. 18 is particularly suitable for the in-works assembling of the panels. The panels 2 are mounted on a frame 80, e.g. fabricated from aluminum section elements, which along the lower edge of the panel acts as a support, and retention clamp and as a spacer having a bead 81, for engagement with and snap-together retention by the coupling means 72 of the gap-covering slate elements 7. Along its lower edge, the frame 80 has the configuration and the function of a retention clamp 82 which engages the upper chamfering 28 of underlying panels.

The tubular transom 5 in this embodiment has two lateral shoulders 60 provided with recesses 54 which accommodate resting section elements 13 for the frame 80 and an advanced intermediate wall 62 having longitudinal recesses 63 in which a spacer section element 64 can be seated also to act as a gasket for watertightness and thermal insulation purposes.

Figure 19:
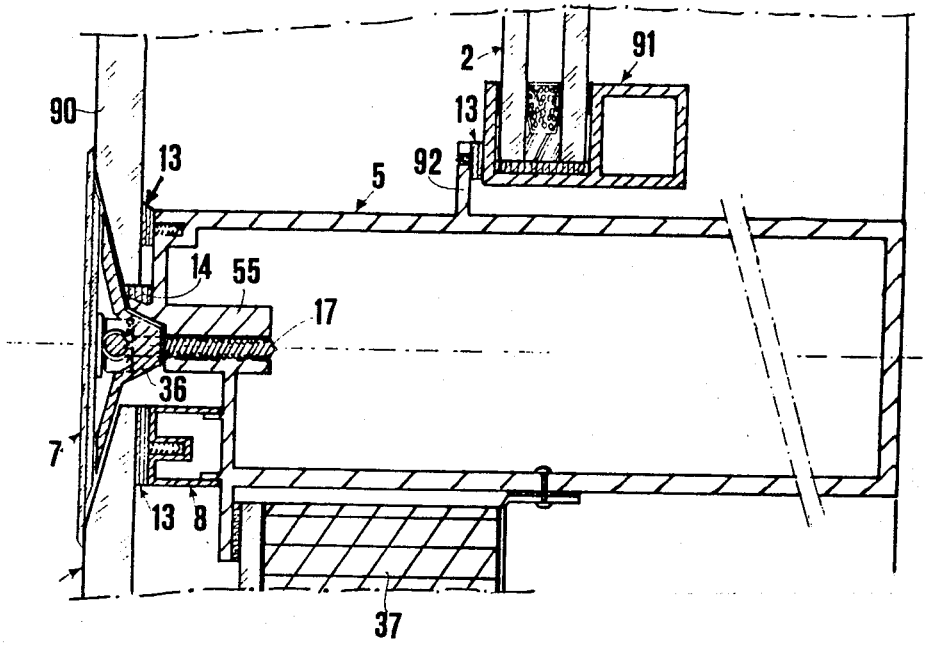
FIG. 19 is a partial vertical sectional view of a glazed facade comprising an outer glass pane and an inner box-like glass panel to a structural glazing system which requires in-yard assemblying of the panes.

FIG. 19 illustrates an embodiment of the structural glazing system according to the present invention, wherein a double panel is provided at non-blank areas of the glazed facade (i.e. at the transparent and/or opening regions). A double panel comprises an outer panel 90, constituted by a beveled or chamfered plate element head fixed to the uprights 4 and the transoms 5 by means of pane-holders 36 with the interposition of section elements 13, and an inner box-like glass panel 2 mounted on a frame 91 which can be secured to a lateral flange 92 of the uprights and of the transoms, with the interposition of T-shaped section elements 13, e.g. by means of bolting or, if required, hinges if the frame 91 must act as an inwardly opening wing.

Figure 22:
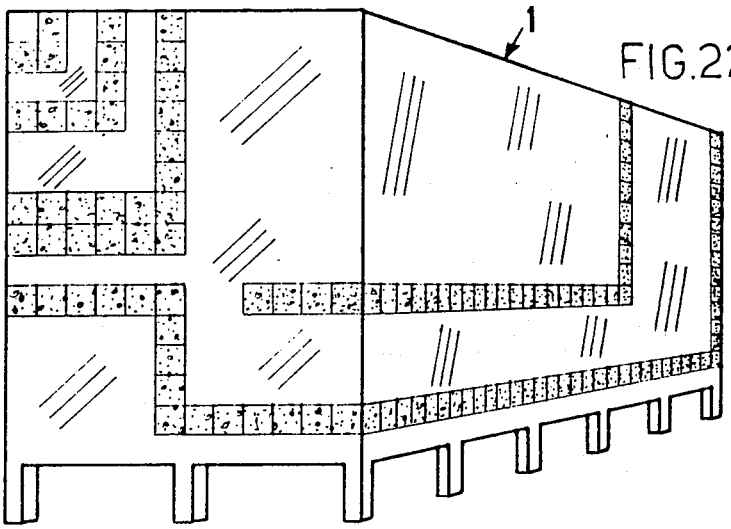
FIGS. 20, 21 and 22 illustrate examples of buildings provided with glazed facades according to the present invention, on which no gaps are visible between the various glass panels at the regions covered with glass panes.
Figure 21:
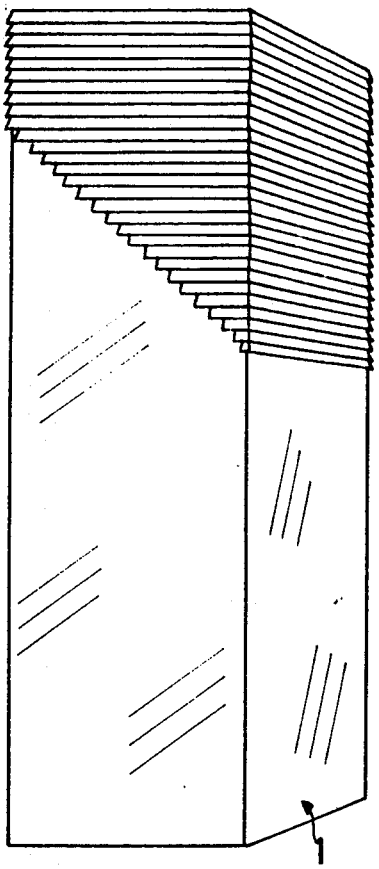
Figure 20:
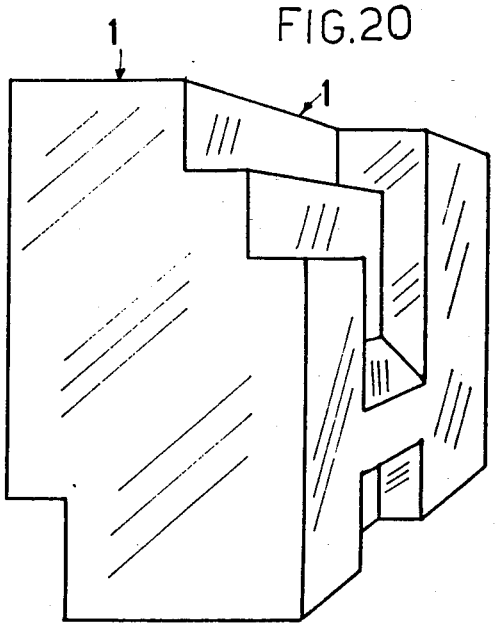

FIGS. 20, 21 and 22 illustrate examples of continuous glazed facades obtained with the structural glazing system according to the present invention. FIG. 20 illustrates all-glass continuous facades without gaps being visible between one panel and the other. FIG. 21 illustrates continuous glazed facades which are all-glass at the lower part thereof and have non-reflecting panels, e.g. sunshading panels different from glass, at their upper part.

FIG. 22 illustrates continuous glazed facades formed by gapless glass panels mixed with non-reflecting panels, e.g. marble plates, aluminum panels, plastic material panels and the like.

FIG. 23 illustrates an outer gap between two panels 2 arranged along two vertical planes at 90°, which is covered by two adjacent slate elements 7 secured, by means of a square spacer section element 95, to a tubular corner upright 4 having two faces 96 and 97 at 90° one with respect to the other.

Figure 24:
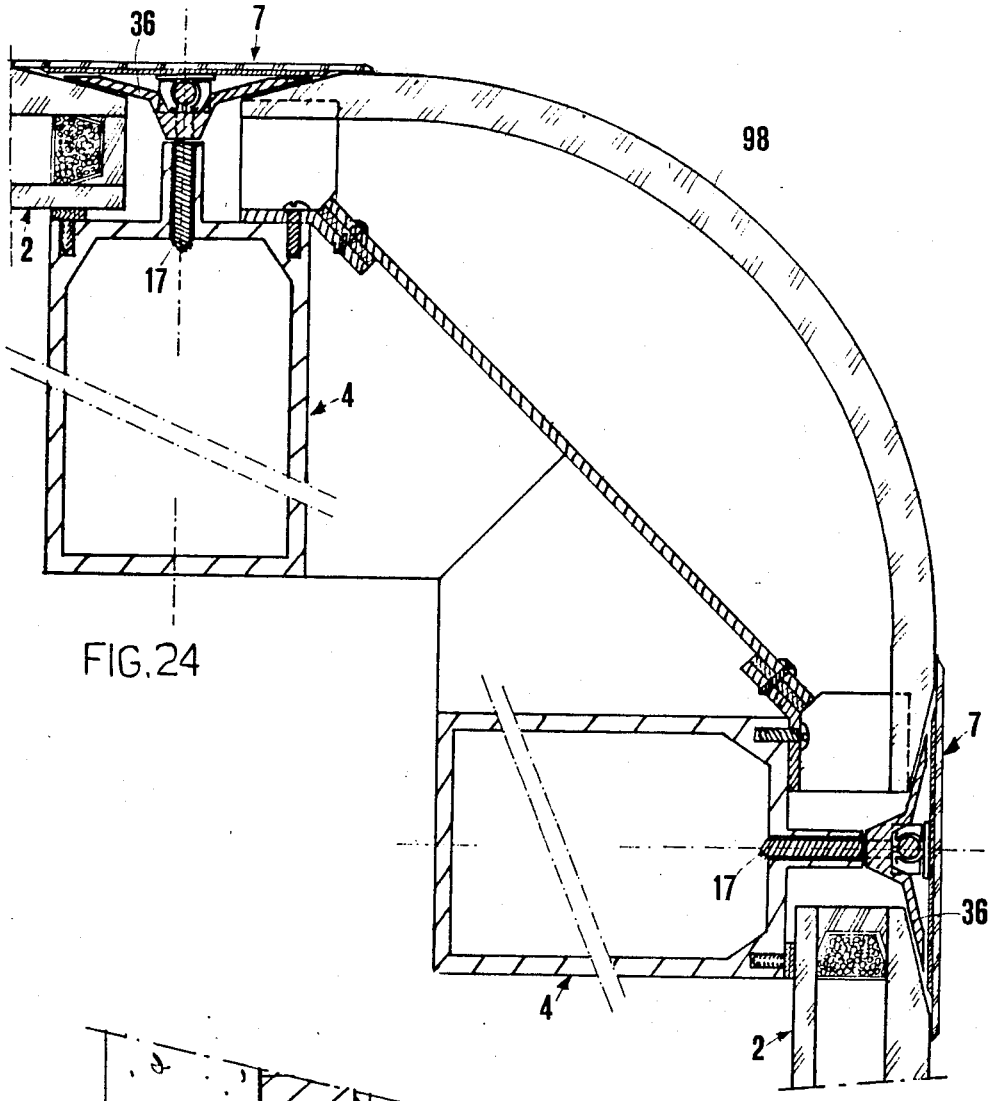
FIG. 24 is a horizontal sectional view taken at a 90° round-edge corner gap of a glazed facade.

FIG. 24 illustrates an embodiment wherein an outer corner gap between two panels at 90° is mostly covered by a curved and beveled pane 98 flanked by two gap-covering section elements.

Figure 25:
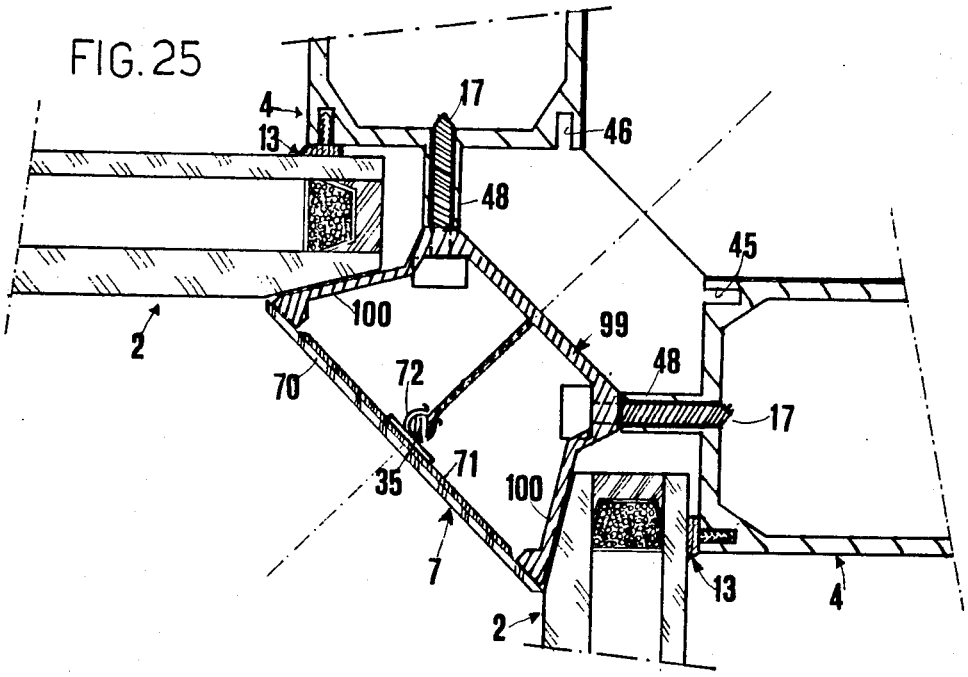
FIG. 25 is a horizontal sectional view at a 90° closed corner gap of a glazed facade.

FIGS. 25 and 26 illustrate two modifications of covering for a gap at an internal 90° corner between adjacent and mutually perpendicular panels 2. In FIG. 25 the gap covering is obtained by means of a single gap-covering section element 7 removably fixed to an U-shaped spacer and pane-holder section element provided with flanges 100 having a complementary inclination with respect to the beveling 27 of the panels. In FIG. 26 gap-covering is obtained by means of two adjacent section elements 7 at 90° with respect to one another and arranged on a pane-holder section element 110.

Figure 27:
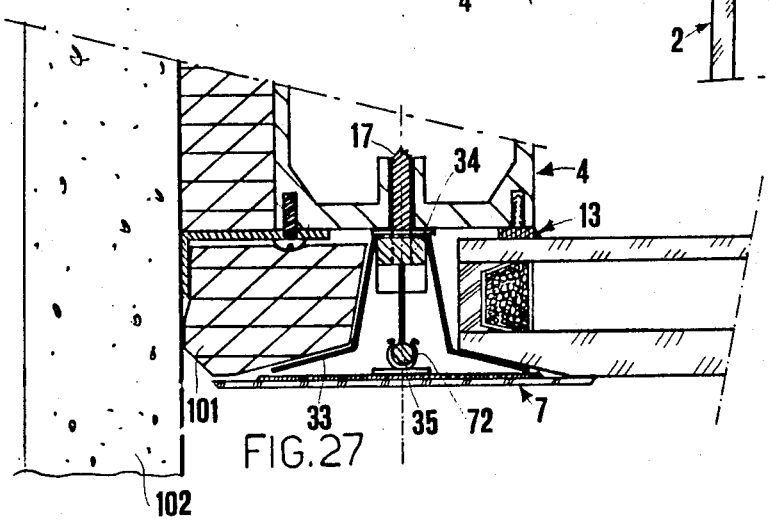
FIG. 27 is a horizontal sectional view at a gap on a lateral wall of a glazed facade.

FIG. 27 illustrates a corner connection where use is made of a blank wedge 101 adjacent to the bearing wall 102.

Figure 28:
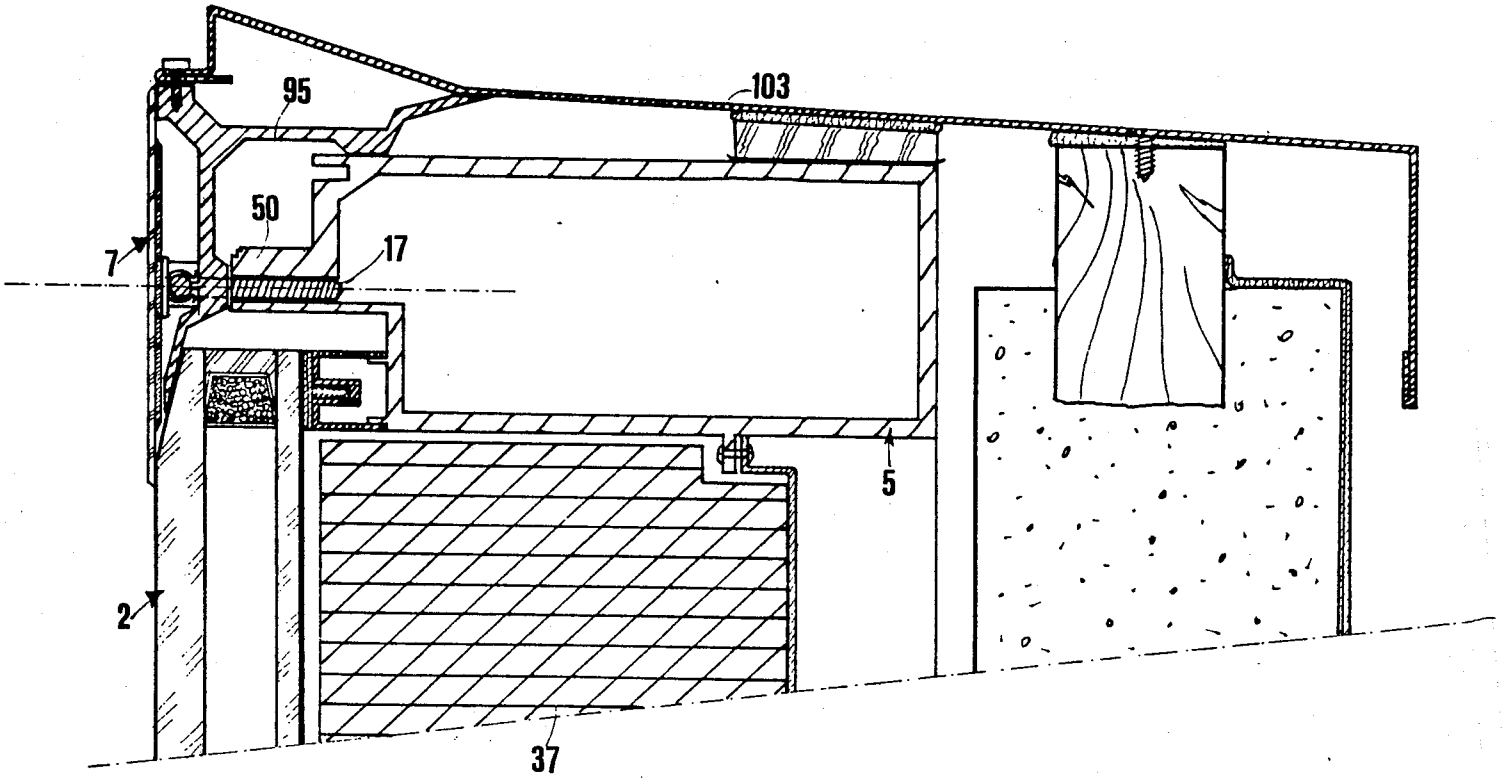
FIG. 28 is a vertical sectional view at a roof ridge of a glazed facade.

Coupling between the transom 5, the panel 2 and the gap-covering profiled section element at the roof ridge of a building is illustrated in FIG. 28, where a spacer and pane-holder section element 95, similar to that of FIG. 23, and a fretted covering plate 103 for the transom 5 and the spacer/plane-holder 95 are used.

Figure 29:
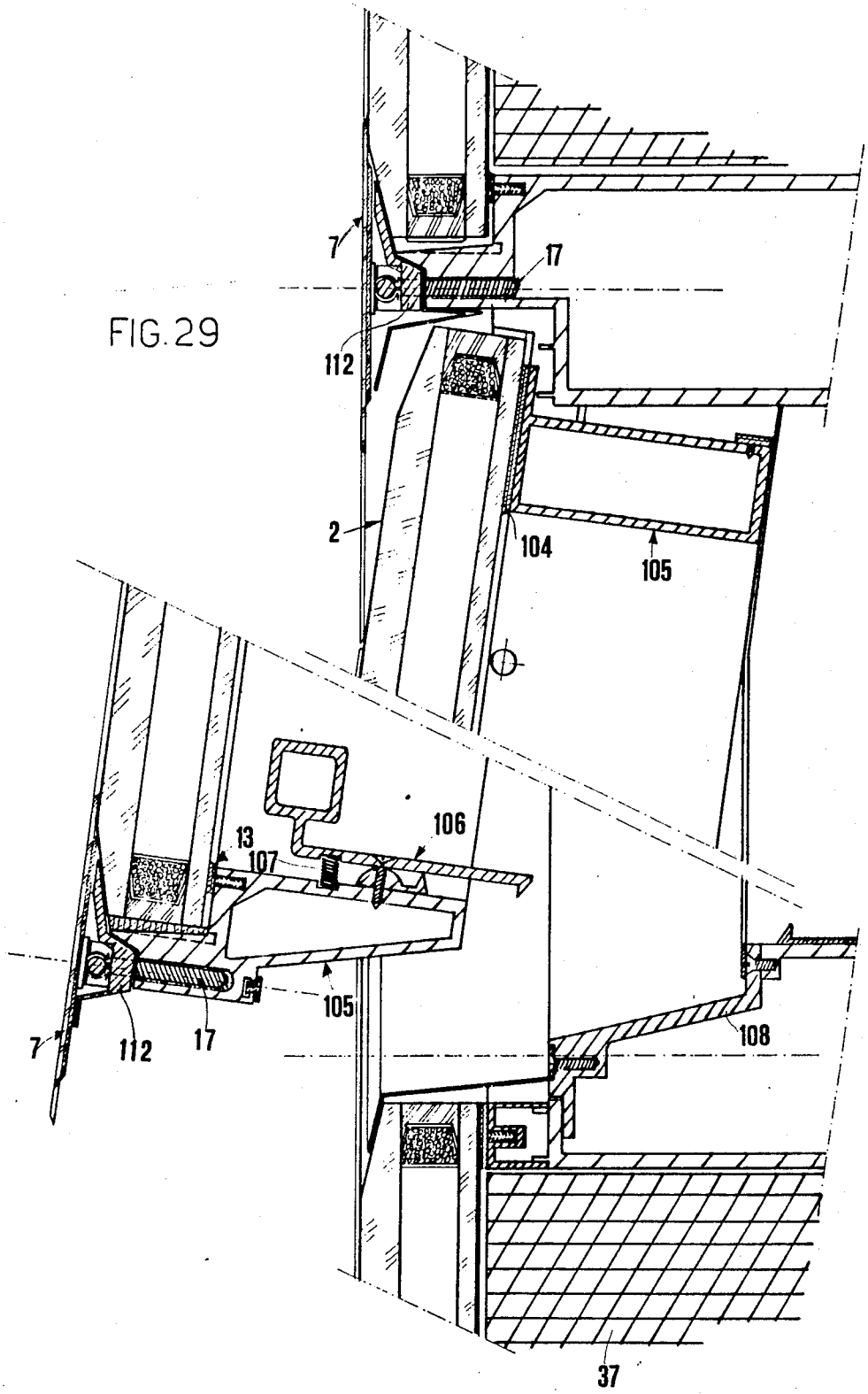
FIGS. 29 and 30 are vertical sectional views taken along outwardly openable window panels of a foldaway type in its partially opened position.
Figure 30:
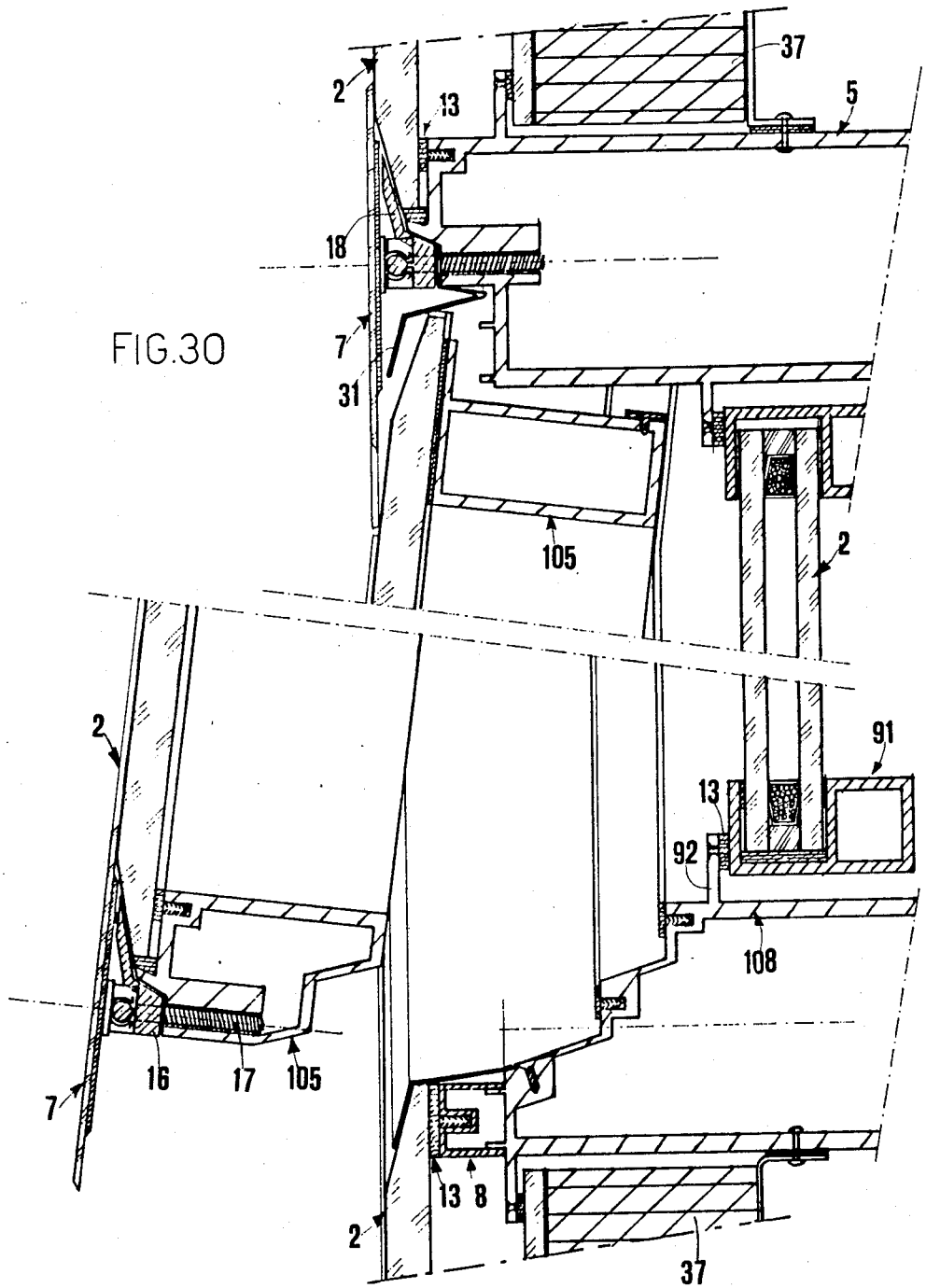
Figure 31:
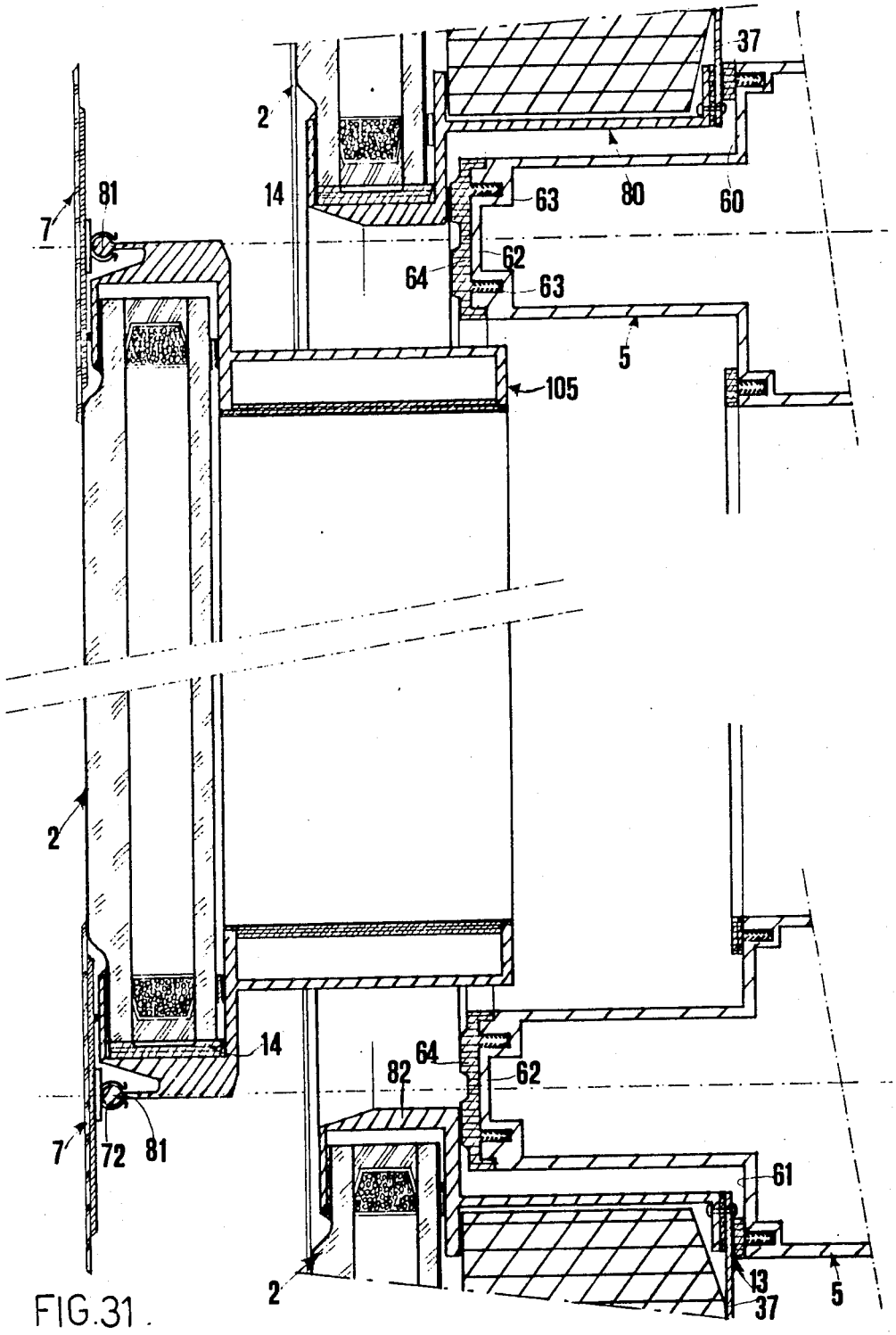
FIG. 31 is a vertical sectional view taken along a sliding window panel.

Window opening panels are available when use is made of structures such as those illustrated in FIGS. 29 to 31. FIG. 29 illustrates a box-like glass panel mounted, e.g. fixed, along its upper edge by means of abutting gaskets 104 and pane-holder section elements 12 along the three other sides on a concealed frame 105 which, in turn, is mounted for rotation about a horizontal axis on two adjacent uprights 4. Along its lower edge and on its two vertical edges, the frame 105 carries an external gap-covering section element 7 fixed to it and a holding device 106 loaded by a spring 107. The holding device 106 is arranged to removably block the movable assembly formed by the panel 2, the frame 105 and its respective gap-covering section element 7 in its closed position against a fixed frame 108.

In FIG. 30 the frame 108 also bears an inner fixed box-like glass panel which can be window opened.

FIG. 31 illustrates a sliding window panel 2 provided with upper, lower and lateral gap-covers.

From the above description and the accompanying drawings it should be apparent that the structural glazing system for producing continuous glazed facades according to the present invention does not require structural silicones or special sealants, but simply sealants easily available and widely used for ordinary production of box-like glass panels, i.e. sealants which do not require specific tests, inspections and approval by the sealant supplier, also because the various panels are mechanically fixed in position by means of the paneholders. Thus, the general contractor/supplier of a continuous glazed facade can directly guarantee his work to his customer without delays or limitations imposed by the sealant supplier.

A particularly advantageous aspect of the present invention is that, in the case of box-like glass panels, the outer panel 21 has a considerable thickness, 8 mm, which is nonetheless currently available on the market. With a thickness of this order of magnitude, as the pressure and the atmospheric temperature vary, which results in corresponding stresses being applied to the box-like glass panel, the pane 21 does not deform to an appreciable extent and maintains a condition of perfect flatness, whereas the much thinner (4-mm) pane 22 will experience deformation. The pane 22, however, has not an aesthetic function. Therefore, its deformation has no visible effect on the flatness of the continuous glazed facade.

Furthermore, as illustrated in FIG. 17, at the blank portions 37 the thick outer reflecting pane 21 can be a nontempered glass pane, while the inner pane 22 can be a tempered glass, 4 mm thick, of the clear float type, fire-enameled at 28, as mentioned above. This particular combination of features, besides ensuring tensile strength for the outer reflecting pane 21 against superheating or heat shocks, allows said outer reflecting pane to remain perfectly flat since it is not tempered, produces optimum uniformity in colors between the transparent and blank regions on the glazed facade even at high light transmission rates or with low percentages of reflected light, and eliminates the risks connected to the peeling of paints or films directly applied to the reflecting pane 21 through cold application processes.

However, with the structural glazing process according to the invention it is possible to use monolithic tempered and enameled or tarnished reflecting panes arranged in a sandwich panel together with polyurethane or phenolic resins and metal plates, e.g. aluminum or steel plates. However it should be noted that glass tempering almost inevitably results in washboard being produced, which causes undesired distorted reflection.

A continuous glazed facade with a reflecting surface according to the invention ensures perfect continuity of reflection, since the small interruptions of a few fractions of a millimeter between each pane and a gap-covering section element are invisible and already disappear from the viewer's sight at a distance of a few meters, although it should be borne in mind that continuous glazed facades are generally viewed at distances of several tens of meters. in the case of failure or cracking due to heat shocks, the glass panels 2 do not fall away, but remain attached to their mounting frame. In any case, defective panels can be easily replaced. The window opening panels are furthermore not recognizable from the outside when they are closed.

The chamfering or beveling operation is a conventional and easy-to-execute operation, and thus it can be performed on any type of reflecting panel 21 or 90 even if the same has a coated surface, so that short supply times may be required.

If required, it is possible to use multi-layer safety or bullet-proof panes for the box-like glass panels, both for the outer and the inner pane.

Removable mounting of the gap-covering section elements 7 allows easy and practical access for inspection purposes after assembling. The slate elements 7 can be fixed in position by means of screws screwed from the outside starting from levels of at least 10–15 m from the ground (at which distance the screws are invisible to the eye) to better withstand any greater breakaway forces, such as wind pressure and windage, which occur at higher levels.

Should the gap-covering slate elements 7 be nonreflecting, they can be painted or otherwise colored in various colors or combinations of colors.

It will be noted that, in the case of continuous reflecting glazed facades with no visible gaps, there is no modular restriction to the view dictated by the supporting upright-and-transom framework from outside, but only in relation to requirements of internal distribution of the buildings. As the replacement of the gap-covering slate elements does not imply operations on the supporting structure and does not affect waterproofing of the facade, even after the assembling of the continuous glazed facade according to the invention it is still possible easily and rapidly to replace at very low costs the reflecting gap-covering slate elements with colored, halved, shaped gap-covers made of different materials, even comprising lights, LEDs, phosphorescent material or any other light source, or slate elements cambered according to a desired configuration with respect to the edge of the pane, with a black line as an imitation of a structural facade, or all black, yellow, red or in any other color to imitate conventional glazed facades.

I claim:

1. A structural glazing system for obtaining continuous glazed facades comprising a structural framing including a plurality of uprights and transoms securable to a supporting structure of a building to be glazed, a plurality of panels, concealed supporting and mounting means clamping said panels to said structural framing to form, in use, a mosaic of coplanar panels defining a continuous glazed facade, said panels being separated from each other by uninterrupted gaps, and a plurality of gap-covering section elements arranged, in use, at said uninterrupted gaps between adjacent panels and being substantially flush with said panels, said gap-covering section elements comprising a sheet-like slate portion having an outer and an inner face, said outer face being arranged, in use, substantially flush to said panels, said inner face defining coupling means arranged for protruding within said uninterrupted gaps and removably cooperating with said supporting and mounting means for removably securing said gap-covering section elements to said structural framing and providing uniformity and continuity to said panel mosaic.

2. A system according to claim 1, wherein each panel has an external bevel along a peripheral edge thereof, said bevel being intended to be engaged, in use, by said supporting and mounting means and concealed from view by said gap-covering section elements.

3. A system according to claim 1, wherein said outer face of said planar slate portion is reflecting.

4. A structural glazing system for obtaining continuous glazed facades comprising:

a structural framing including a plurality of uprights and transoms securable to a supporting structure of a building to be glazed, a plurality of panels to be secured to said structural framing to form a mosaic of co-planar panels defining a continuous glazed facade, said panels being separated from each other by uninterrupted gaps and defining each an external engagement edge portion, concealed supporting and mounting means for clamping said panels to said structural framing, said supporting and mounting means extending within said uninterrupted gaps and comprising at least one monolithical pane-holder section element and an engagement member, said pane-holder section element including a frame coupling portion for resting against and being secured to said structural framing, and a panel clamping portion for resting against said external engagement edge portion of said panels, said engagement member being secured to said pane-holder section element, and a plurality of gap-covering section elements arranged, in use, at said uninterrupted gaps between adjacent panels and comprising a sheet-like slate portion having an outer and an inner face, said outer face being arranged, in use, substantially flush to said panels and covering said supporting and mounting means, and said inner face defining coupling means protruding, in use, within said uninterrupted gaps and cooperating with said engagement member for removably securing said gap-covering section elements to said supporting and mounting means and to said structural framing, said gap-covering section elements providing uniformity and continuity to said panel mosaic.

5. A system according to claim 4, wherein said external engagement edge portion of said panels defines a beveled external engagement edge portion and said panel clamping portion of said pane-holder section elements comprises at least one thin arm portion for resting within said uninterrupted gaps against said beveled external engagement edge portion of said panels and being concealed by said gap-covering section elements.

6. A structural glazing system for obtaining continuous glazed facades comprising:

a structural framing including a plurality of uprights and transoms securable to a supporting structure of a building to be glazed, a plurality of panels to be secured to said structural framing to form a mosaic of co-planar panels defining a continuous glazed facade, said panels being separated from each other by uninterrupted gaps and defining each an external engagement edge portion, concealed supporting and mounting means for clamping said panels to said structural framing, said supporting and mounting means extending within said uninterrupted gaps and comprising at least one monolithical pane-holder section element and an engagement member, said pane-holder section element including a frame coupling portion for resting against and being secured to said structural framing, and a thin, arm-like panel clamping portion for resting against said external engagement edge portion of said panels, said engagement member being secured to said frame coupling portion of said pane-holder section element for accomodation within said uninterrupted gaps, and a plurality of gap-covering section elements arranged, in use, at said uninterrupted gaps between adjacent panels and comprising a slate portion having an outer and an inner face, said outer face being arranged, in use, substantially flush to said panels and covering said supporting and mounting means, and said inner face defining coupling means protruding, in use, within said uninterrupted gaps and cooperating with said engagement member for removably securing said gap-covering section elements to said supporting and mounting means and to said structural framing, said gap-covering section elements providing uniformity and continuity to said panel mosaic.

7. A system according to claim 6, wherein at least one panel comprises a box-like glass panel having an outer pane and an inner pane arranged parallel to and spaced from said outer pane, said outer pane being considerably thicker than said inner pane.

8. A system according to claim 6, comprising an outer reflecting pane in combination with an inner box-like glass panel having an outer thick pane and an inner thin pane arranged parallel to and spaced from said outer thick pane, at transparent regions of the glazed facade and an outer reflecting pane in combination with an opaque panelling at blank regions thereof.

9. A system according to claim 8, wherein said outer reflecting pane is not tempered.

10. A system according to claim 6, wherein said pane-holder section element is monolithical with said engagement member and is secured to said structural framing through screw means.

11. A system according to claim 6, wherein said pane-holder section element is connected to said engagement member and to said structural framing through screw means.

12. A system according to claim 6, wherein said gap-covering section element has a reflecting outer surface.

13. A system according to claim 6, wherein said gap-covering section element comprises an outer laminar layer and at least one internal stiffening and supporting layer rigid with said coupling means.

14. A system according to claim 6, wherein said coupling means and said engagement member comprise resiliently yielding groove and tongue joint defining a snap coupling.

15. A system according to claim 6, wherein each upright comprises a first tubular section element having a free resting face for panels defining at least one pair of longitudinal recesses arranged to receive gasket elements and said transoms comprise a second tubular section element having a protruding bracket for supporting said panels and securing said pane-holder section element and two abutment shoulders for supporting said panels with the interposition of at least one gasket element.

* * * * *